United States Patent [19]

Salsgiver et al.

[11] Patent Number: 4,919,733

[45] Date of Patent: Apr. 24, 1990

[54] METHOD FOR REFINING MAGNETIC DOMAINS OF ELECTRICAL STEELS TO REDUCE CORE LOSS

[75] Inventors: James A. Salsgiver, Sarver; Randal K. Knipe; Carl P. Stroble, both of Natrona Heights, all of Pa.

[73] Assignee: Allegheny Ludlum Corporation, Pittsburgh, Pa.

[21] Appl. No.: 163,448

[22] Filed: Mar. 3, 1988

[51] Int. Cl.[5] ..... H01F 1/04

[52] U.S. Cl. ..... 148/113; 148/112; 148/121; 148/122; 219/121.19; 219/121.35

[58] Field of Search ..... 148/111, 112, 113, 120, 148/121, 122; 219/121.12, 121.35

[56] References Cited

U.S. PATENT DOCUMENTS

| | | | |
|---|---|---|---|
| 3,192,078 | 6/1965 | Gordon et al. | 148/121 |
| 3,276,922 | 10/1966 | Sery et al. | 148/121 |
| 3,477,883 | 11/1969 | Sery et al. | 148/121 |
| 3,990,923 | 11/1976 | Takashina et al. | 148/111 |
| 4,554,029 | 11/1985 | Schoen et al. | 148/112 |
| 4,645,547 | 2/1987 | Krause et al. | 148/111 |

FOREIGN PATENT DOCUMENTS

| | | | |
|---|---|---|---|
| 57-161030 | 10/1982 | Japan | 148/120 |
| 58-144424 | 8/1983 | Japan | 148/120 |
| 60-216511 | 10/1985 | Japan | 148/121 |
| 0926032 | 5/1982 | U.S.S.R. | 148/120 |

*Primary Examiner*—John P. Sheehan

*Attorney, Agent, or Firm*—Patrick J. Viccaro

[57] ABSTRACT

A method is provided for domain refinement of electrical sheet products, such as grain-oriented silicon steel and amorphous magnetic materials, by subjecting at least one surface of the steel to an electron beam treatment to produce narrow substantially parallel bands of treated regions separated by untreated regions substantially transverse to the direction of strip manufacture to improve core loss without damaging the surface or any coating thereon.

14 Claims, 2 Drawing Sheets

MELT ZONE

INTERFACE

BASEMETAL

APPROXIMATE WIDTH OF TREATED ZONE

COPPER SPACER

COATING

BASEMETAL

METHOD FOR REFINING MAGNETIC DOMAINS OF ELECTRICAL STEELS TO REDUCE CORE LOSS

BACKGROUND OF THE INVENTION

This invention relates to a method for working the surface of electrical sheet or strip products to affect the domain size so as to reduce the core loss properties. More particularly, this invention relates to providing localized strains in the surface of electrical steels by electron beam treatment without damaging any coating thereon or changing the shape thereof to improve core loss.

In the manufacture of grain oriented silicon steel, it is known that the Goss secondary recrystallization texture, (110)[001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

Grain-oriented silicon steel is conventionally used in electrical applications, such as power transformers, distribution transformers, generators, and the like. The domain structure and resistivity of the steel in electrical applications permits cyclic variation of the applied magnetic field with limited energy loss, which is termed "core loss".

It is desirable, therefore, in steels used for such applications, that such steels have reduced core loss values.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain oriented silicon steel and second, high permeability grain oriented silicon steel. Regular grain oriented silicon steel is generally characterized by permeabilities of less than 1850 at 10 Oersteds with a core loss of greater than 0.400 watts per pound (WPP) at 1.5 Tesla at 60 Hertz for nominally 9 mil material. High permeability grain oriented silicon steels are characterized by higher permeabilities and lower core losses. Such higher permeability steels may be the result of compositional changes alone or together with process changes. For example, high permeability silicon steels may contain nitrides, sulfides and/or borides which contribute to the precipitates and inclusions of the inhibition system which contribute to the properties of the final steel product. Furthermore, such high permeability silicon steels generally undergo cold reduction operations to final gauge wherein a final heavy cold reduction on the order of greater than 80% is made in order to facilitate the grain orientation.

It is known that domain size and thereby core loss values of electrical steels, such as amorphous materials and particularly grain-oriented silicon steels, may be reduced if the steel is subjected to any of various practices to induce localized strains in the surface of the steel. Such practices may be generally referred to as "scribing" or "domain refining" and are performed after the final high temperature annealing operation. If the steel is scribed after the final texture annealing, then there is induced a localized stress state in the texture annealed sheet so that the domain wall spacing is reduced. These disturbances typically are relatively narrow, straight lines, or scribes generally spaced at regular intervals. The scribe lines are substantially transverse to the rolling direction and typically are applied to only one side of the steel.

In the use of such amorphous and grain-oriented silicon steels, the particular end use and the fabrication techniques may require that the scribed steel product survive a stress relief anneal (SRA), while other products do not undergo such an SRA. During fabrication incident to the production of stacked core transformers and, more particularly, in the power transformers of the United States, there is a demand for a flat, domain refined silicon steel which is not subjected to stress relief annealing. In other words, the scribed steel does not have to provide heat resistant domain refinement.

During the fabrication incident to the production of other transformers, such as most distribution transformers in the United States, the steel is cut and subjected to various bending and shaping operations which produce stresses in the steel. In such instances, it is necessary and conventional for manufacturers to stress relief anneal the product to relieve such stresses. During stress relief annealing, it has been found that the beneficial effect on core loss resulting from some scribing techniques, such as thermal scribing, are lost. For such end uses, it is required and desired that the product exhibit heat resistant domain refinement (HRDR) in order to retain the improvements in core loss values resulting from scribing.

It has also been suggested in prior patent art that electron beam technology may be suitable for scribing silicon steel. U.S. Pat. No. 3,990,923-Takashina et al., dated Nov. 9, 1976 discloses that electron beams may be used on primary recrystallized silicon steel to control or inhibit the growth of secondary recrystallization grains. U.S. Pat. No. 4,554,029-Schoen et al., dated Nov. 19, 1985, generally discloses that electron beam resistance heating may be used on finally annealed electrical steel if damage of the insulative coating is not of concern. The damage to the insulative coating and requirements of a vacuum were considered to be major drawbacks. There is no teaching or suggestion in the art, however, of any actual or practical use of electron beam technology for scribing electrical steels.

A copending application, Ser. No. 163,670, filed Mar. 3, 1988, by the assignee of this invention discloses a method and apparatus for electron beam treatment to provide heat resistant domain refinement.

What is needed is a method and apparatus for treating electrical sheet products to effect domain refinement without disrupting or destroying any coating, such as an insulation coating or mill glass on the sheet and without substantially changing or affecting the sheet shape. Still further, the method and apparatus should be suitable for treating grain-oriented silicon steels of both the high permeability and conventional types as well as amorphous type electrical materials.

SUMMARY OF THE INVENTION

In accordance with the present invention, there is provided a method for improving the core loss of electrical sheet or strip having final annealed magnetic domain structures, the method which includes subjecting at least one surface of the sheet to an electron beam treatment to produce narrow substantially parallel bands of treated regions separated by untreated regions substantially transverse to the direction of sheet manufacture. The electron beam treatment includes providing a linear energy density sufficient to produce refinement of magnetic domain wall spacing without changing the sheet shape or damaging the sheet coating.

DETAILED DESCRIPTION OF THE PREFERRED EMBODIMENTS

Figure 1:
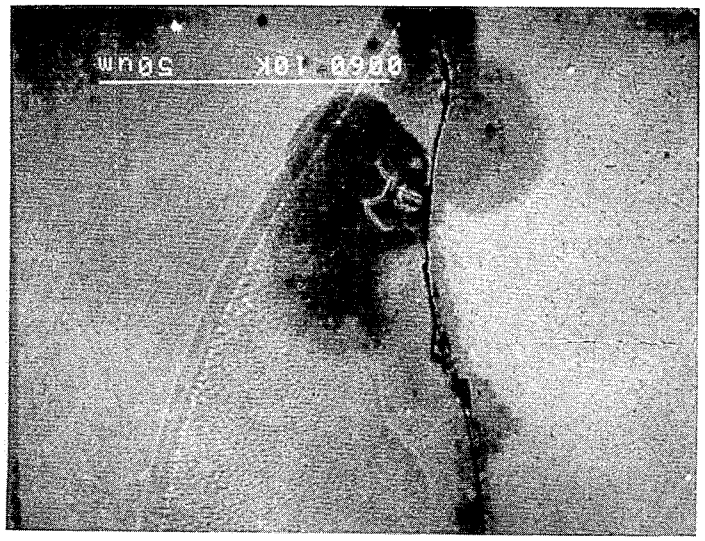
FIG. 1 is a photomicrograph in cross-section of Steel 2 of Pack 40-33A of Example 1.

Broadly, in accordance with the present invention, a method is provided for improving the magnetic properties of regular and high permeability grain-oriented silicon steels and amorphous materials. Preferably, the method is useful for treating such steels to effect a refinement of the magnetic domain wall spacing for improving core loss of the steel strip. The width of the scribed lines and the spacing of the treated regions or lines substantially transverse to the rolling direction of the silicon strip and to the casting direction of amorphous material is conventional. What is not conventional, however, is the method of the present invention for effecting such magnetic domain wall spacing in a controlled manner such that the steel so treated has improved magnetic properties and may be used without damaging any coating on the steel, such as mill glass typically found on silicon steel and surface oxides on amorphous metals, so as to avoid any recoating operation.

Typical electron beam generating equipment used in welding and cutting, for example, requires that the electron beam be generated in and used in at least a partial vacuum in order to provide control of the beam and spot size or width focused on the workpiece. Such typical equipment was modified and used in the development of the present invention. A particular modification included high frequency electron beam deflection coils to generate selected patterns to scan the electrical sheet. The speed at which the electron beam traversed the steel sheet was controlled in the laboratory development work by setting the scan frequency with a waveform generator (sold by Wavetek) which drove the electron beam deflection coils.

As used herein, the electron beam useful in the present invention could have a direct current (DC) for providing continuous beam energy or a modulated current for providing pulsed or discontinuous beam energy. Unless otherwise specified herein, the DC electron beam was used in the examples. Furthermore, although a single electron beam was used, a plurality of beams may be used to create a single treated or irradiated region or to create a plurality of regions at the same time.

Other parameters or conditions of the electron beam must also be selected within certain ranges in order to provide the proper balance to effect the domain refinement. The current of the electron beam may range from 0.5 to 100 milliamperes (ma); however, narrower preferred ranges may be selected for specific equipment and conditions as described herein. The voltage of the electron beam generated may range from 20 to 200 kilovolts (kV), preferably 60 to 150 kV. For these ranges of currents and voltages, the speed at which the electron beam traverses the steel strip must be properly selected in order to effect the domain refinement to the extent desired without overstressing or damaging the steel strip or, without disrupting any coating thereon. It has been found that the scanning speed may range from as low as 50 inches per second (ips) to as great as 10,000 ips. It should be understood that the parameters of current, voltage, scan speed, and strip speed are interdependent for a desired scribing effect; selected and preferred ranges of these parameters are dependent upon machine design and production requirements. For example, the electron beam current is adjusted to compensate for the speed of the strip and the electron beam scan speed. As a practical matter, based on the speed of the strip, the scan speed for a given width of strip would be determined and from that the desired and suitable electrical parameters would be set to satisfactorily treat the strip in accordance with the present invention.

The size of the electron beam focused on and imparting energy to the strip is also an important factor in determining the effect of domain refinement. Conventional electron beam generating equipment can produce electron beam diameters on the order of 4 to 16 mils in a hard vacuum, usually less than about $10^{-4}$Torr. The electron beam generally produced focuses an elliptical or circular spot size. It is expected that other shapes may be suitable. The focussed beam spot size effectively determines the width of the narrow irradiated or treated regions. The size across the focussed spot, in terms of diameter or width, of the electron beam used in the laboratory development work herein was on the order of 5 mils, unless otherwise specified.

A key parameter for the electron beam treatment in accordance with the present invention is the energy being transferred to the electrical material. Particularly, it was found that it is not the beam power, but the energy density which is determinative of the extent of treatment to the sheet material. The energy density is a function of the electron current, voltage, scanning speed, spot size, and the number of beams used on the treated region. The energy density may be defined as the energy per area in units of Joules per square inch ($J/in^2$). The areal energy density may range from about 60 $J/in^2$ or more, and preferably from 60 to 260 $J/in^2$ (9.3 to 40.3 $J/cm^2$). In developing the present invention, the electron beam spot size of 5 mils was constant. The linear energy density can be simply calculated by dividing the beam power (in J/sec. units) by the beam scanning speed (in ips units). With low beam currents of 0.5 to 10 ma and relatively high voltage of 150 kV, the linear energy density, expressed in such units, may range from about 0.3 J/in or more and from about 0.3 to 1.3 J/inch (0.1 to 0.5 J/cm), and preferably from 0.4 to 1.0 J/in. (0.2 to 0.4 J/cm). Broadly, the upper limit of energy density is that value at which damage to the surface or coating would occur.

The specific parameters within the ranges identified depend upon the type and end use of the domain refined electrical steel. The electron beam treatment for the present invention will vary somewhat between grain-oriented silicon steels of the regular or conventional type and a high permeability steel as well as with amorphous metals. Any of these magnetic materials may have a coating thereon such as surface oxides from processing, forsterite base coating, insulation coating mill glass, applied coating, or combinations thereof. As used herein, the term "coating" refers to any such coating or combinations thereof. Another factor to consider in establishing the parameters for electron beam treatment is whether or not the coating on the final annealed electrical steel is damaged as a result of the treatment. Generally, it would be advantageous and desirable that the surface of the material and any coating not be damaged or removed in the areas of the induced stress so as to avoid any surface roughness and any subsequent recoating process. Thus the selection of the parameters to be used for electron beam treatment should also take into consideration any possible damage to the metal surface and any coating.

Although the present invention described in detail hereafter has utility with electrical steel generally, the following typical compositions are two examples of grain-oriented silicon steel compositions and an amorphous steel composition useful with the present invention and which were used in developing the present invention. The steel melts of the three (3) steels initially contained the nominal compositions of:

| Steel | C | N | Mn | S | Si | Cu | B | Fe |
|---|---|---|---|---|---|---|---|---|
| 1 | .030 | 50 PPM | .07 | .022 | 3.15 | .22 | — | Bal. |
| 2 | .030 | Less than 50 PPM | .038 | .017 | 3.15 | .30 | 10 PPM | Bal. |
| 3 | — | — | — | — | 3.0 | — | 3.0 | Bal. |

Steel 1 is a conventional grain-oriented silicon steel and Steel 2 is a high permeability grain-oriented silicon steel and Steel 3 is a magnetic amorphous steel. (Typically, amorphous materials have compositions expressed in terms of atomic percent. Steel 3 has a nominal composition of 77–80 Fe, 13–16 Si, 5–7 B, in atomic percent.). Unless otherwise noted, all composition ranges are in weight percent.

Both Steels 1 and 2 were produced by casting, hot rolling, normalizing, cold rolling to final gauge with an intermediate annealing when two or more cold rolling stages were used, decarburizing, coating with MgO and final texture annealing to achieve the desired secondary recrystallization of cube-on-edge orientation. After decarburizing the steel, a refractory oxide base coating containing primarily magnesium oxide was applied before final texture annealing at elevated temperature; such annealing caused a reaction at the steel surface to create a forsterite base coating. Although the steel melts of Steels 1 and 2 initially contained the nominal compositions recited above, after final texture annealing, the C, N and S were reduced to trace levels of less than about 0.001% by weight. Steel 3 was produced by rapid solidification into continuous strip form and then annealed in a magnetic field, as is known for such materials.

In order to better understand the present invention, the following examples are presented.

EXAMPLE I

To illustrate the several aspects of the domain refining process of the present invention, a sample of the silicon steel having a composition similar to Steel 2 was melted, cast, hot rolled, cold rolled to a final gauge of about 9-mils, intermediate annealed when necessary, decarburized, final texture annealed with an MgO annealing separator coating, heat flattened, and stress coated. The samples were magnetically tested as received before electron beam treatment to effect domain refinement and acted as control samples. One surface of the steel was subjected to an electron beam irradiation of narrow substantially parallel bands to produce treated regions separated by untreated regions substantially transverse to the rolling direction at speeds indicated in Table I. All of the samples, except one, were treated by fixing the samples in place and scanning the electron beam across the strips. For Epstein Pack 40-33A, the strips were passed under a stationary or fixed electron beam at 200 ipm. Pack 40-33A was also the only one having base-coated strips. All other samples were tension-coated. All samples were about 1.2 inches wide.

The electron beam was generated by a machine manufactured by Leybold Heraeus. The machine generated a beam having a focussed spot size of about 5 mils for treating the steels in a vacuum of about $10^{-4}$ Torr or better. The parallel bands of treated regions were about 6 millimeters apart.

The magnetic properties of core loss at 60 Hertz (Hz) at 1.3, 1.5 and 1.7 Tesla, permeability at 10 Oersteds (H) and at an induction of 200 Gauss were determined in a conventional manner for Epstein Packs.

TABLE I

| Epstein Pack | Electron Beam Conditions: Current ma | Voltage kV | Speed ips | % Improvements in Core Loss Over Control: 1.3 T | 1.5 T | 1.7 T | Core loss @ 60 Hz mWPP: 1.3 T | 1.5 T | 1.7 T | Permeability: @ 10 H | @ 200 B | Linear Energy Density Joules/inch |
|---|---|---|---|---|---|---|---|---|---|---|---|---|
| 40-33A | | | | | | | | | | | | |
| (Control) | — | — | — | — | — | — | 324 | 435 | 613 | 1896 | 11,600 | — |
| Treated | 1 | 60 | 3.3 | NI | NI | NI | 616 | 767 | 966 | 814 | 286 | 17.5 |
| 40-3 | | | | | | | | | | | | |
| (Control) | — | — | — | — | — | — | 330 | 439 | 611 | 1880 | 10,990 | — |

TABLE I-continued

| Epstein Pack | Electron Beam Conditions Current ma | Voltage kV | Speed ips | % Improvements in Core Loss Over Control 1.3 T | 1.5 T | 1.7 T | Core loss @ 60 Hz mWPP 1.3 T | 1.5 T | 1.7 T | Permeability @ 10 H | @ 200 B | Linear Energy Density Joules/inch |
|---|---|---|---|---|---|---|---|---|---|---|---|---|
| Treated* | 2 | 60 | 1440 | 10.6 | 8.9 | 8.5 | 295 | 400 | 559 | 1884 | 11,980 | N/A |
| 40-5 | | | | | | | | | | | | |
| (Control) | — | — | — | — | — | — | 317 | 425 | 586 | 1889 | 11,630 | — |
| Treated | 3 | 60 | 1440 | NI | NI | NI | 417 | 554 | 737 | 1869 | 6,600 | N/A |
| 40-7 | | | | | | | | | | | | |
| (Control) | — | — | — | — | — | — | 313 | 418 | 561 | 1909 | 13,070 | — |
| Treated | 2 | 60 | 1440 | 3.8 | 4.1 | 3.4 | 301 | 401 | 542 | 1912 | 13,605 | N/A |

*Epstein pack contained only 16 strips, all others contained 20 strips.
NI - No improvement
N/A - Not available Under the experimental conditions described above for the electron beam, linear energy density, current, voltage, and traversing speed, Table I shows the effects of the domain refinement on the magnetic properties of the grain-oriented silicon steel of Steel 2. Domain imaging was conducted in a known manner on each sample with magnetite suspension and flexible permanent magnets to determine the effect on domain refinement.

Domain refinement was achieved in Pack 40-33A but the electron beam conditions were of such severity that the Epstein strips were bent and deep grooves were cut through the coating on the silicon steel. The grooves were rough to the touch and would require further processing in an effort to make a satisfactory final product. Domain refinement was also achieved in other samples but without damage to the coating and without severely warping the strip. FIG. 1 is a photomicrograph in cross-section of a portion of the treated region of Steel 2 shown by a nital etching to illustrate the treated region of Pack 40-33A.

Some Epstein Packs were subjected to the electron beam domain refinement without disrupting the coating. Pack 40-3 was subjected to the treatment in accordance with the parameters set out in Table I and resulted in successful domain refinement without any visible damage to the coating and with minimal warpage of the strip. The electron beam treatment reduced the losses at 1.7T by about 8.5%, at 1.5T by about 8.9%, and at 1.3T by about 10.6%. The duration of the scan pattern was not precisely controlled, however, so the linear energy density value was not known.

The electron beam conditions for Epstein Pack 40-5 having a current of 3 ma were more severe and resulted in giving the strips a slight curvature and increased core loss magnetic properties. Interestingly enough, however, the coating on the strips was not vaporized in most places, i.e. the coating was intact and not visibly damaged.

Epstein Pack 40-7 was domain refined at 2 ma current to repeat the treatment given 40-3. As shown in Table I, Pack 40-7 exhibits loss reductions at 1.7T of 4.1%, at 1.5T at 3.4%, and at 1.3T of 3.8%. The coating was not visibly disrupted although there may have been some warping of the strips as a result of the domain refining process.

The data of samples 40-3 and 40-7 demonstrate that an electron beam treatment can provide a process for producing a useful domain refined product without further processing steps which product could be useful in power transformer applications. The watt loss reductions observed for Packs 40-3 and 40-7 without visibly damaging the coating and with minimal warpage was on the order of 3.5 to 10.5%.

EXAMPLE II

By way of further examples, additional tests were performed to demonstrate different electron beam conditions of linear energy density, current, voltage and traversing speed for non-destructive domain refining treatment. All of the samples were obtained from various heats of nominally 9-mil gauge silicon steel having the typical composition of Steel 2. Each sample was prepared in a manner similar to that in Example 1 but treated under the experimental conditions described in Table II. All of the domain refining was done with an electron beam having a voltage of 150 kilovolts and the lowest possible current available in electron beam equipment, i.e. 0.75 milliamperes. All of the magnetic properties are single sheet results from panels of 4×22 inches.

TABLE II

| Single Sheet Sample | Electron Beam Conditions Current ma | Voltage kV | Speed ips | % Improvement in Core Loss Over Control 1.3 T | 1.5 T | 1.7 T | Core loss @ 60 Hz mWPP 1.3 T | 1.5 T | 1.7 T | Permeability @ 10 H | @ 200 B | Linear Energy Density Joules/inch |
|---|---|---|---|---|---|---|---|---|---|---|---|---|
| 65ABC | | | | | | | | | | | | |
| (Control) | — | — | — | — | — | — | 302 | 425 | 613 | 1881 | 11,490 | — |
| (Treated) | .75 | 150 | 125 | 3.6 | 6.1 | 8.5 | 291 | 399 | 561 | 1870 | 11,760 | 0.9 |
| 66ABC | | | | | | | | | | | | |
| (Control) | — | — | — | — | — | — | 307 | 429 | 612 | 1870 | 11,980 | — |
| (Treated) | .75 | 150 | 150 | 5.2 | 6.8 | 6.7 | 291 | 400 | 570 | 1863 | 12,580 | 0.75 |
| 67ABC | | | | | | | | | | | | |
| (Control) | — | — | — | — | — | — | 305 | 429 | 616 | 1870 | 11,700 | — |
| (Treated) | .75 | 150 | 175 | 8.2 | 9.3 | 8.9 | 280 | 389 | 561 | 1863 | 12,580 | 0.64 |
| 68ABC | | | | | | | | | | | | |
| (Control) | — | — | — | — | — | — | 308 | 430 | 611 | 1879 | 12,120 | — |
| (Treated) | .75 | 150 | 250 | 12.3 | 11.6 | 10.0 | 270 | 380 | 550 | 1879 | 13,330 | 0.45 |
| 46DEF | | | | | | | | | | | | |

TABLE II-continued

| Single Sheet Sample | Electron Beam Conditions Current ma | Voltage kV | Speed ips | % Improvement in Core Loss Over Control 1.3 T | 1.5 T | 1.7 T | Core loss @ 60 Hz mWPP 1.3 T | 1.5 T | 1.7 T | Permeability @ 10 H | @ 200 B | Linear Energy Density Joules/inch |
|---|---|---|---|---|---|---|---|---|---|---|---|---|
| (Control) | — | — | — | — | — | — | 297 | 422 | 603 | 1909 | 12,050 | — |
| (Treated) | .75 | 150 | 100 | 3.7 | 7.8 | 10.1 | 286 | 389 | 542 | 1898 | 13,160 | 1.12 |
| 52DEF | | | | | | | | | | | | |
| (Control) | — | — | — | — | — | — | 298 | 413 | 589 | 1904 | 10,640 | — |
| (Treated) | .75 | 150 | 150 | 8.1 | 8.5 | 9.2 | 274 | 378 | 535 | 1890 | 11,700 | 0.75 |
| 54DEF | | | | | | | | | | | | |
| (Control) | — | — | — | — | — | — | 303 | 422 | 603 | 1889 | 12,350 | — |
| (Treated) | .75 | 150 | 200 | 6.9 | 7.8 | 7.5 | 282 | 389 | 558 | 1889 | 13,510 | 0.56 |

Under the experimental conditions described above, good results were obtained over a wide range of traversing speed with lower current and a higher voltage than exhibited in Example 1. Samples exhibited negligible warping or curvature and none exhibited any visible disruption or disturbance of the coating. All of the samples showed core loss reductions ranging from 6.1 to 11.6% at 1.5T. From these tests, it appears that for 5-mil wide treated regions the selection of process parameters to yield linear energy densities of up to 1.2 J/in. (60 to 240 J/in$^2$) can result in domain refinement without visibly damaging the coating. For 150 kilovolts, the best results were obtained with about 0.45 joules per inch (0.2 joules/cm).

It was separately found that when the 0.75 ma electron beam traversed too slowly across the surface of the strip, below about 50 ips, a visible disruption or dimpling of the surface coating was apparent. When the electron beam traversing speed was greater than 50 ips, there was no visible disruption of the coating. Good results were obtained with beam traversing speeds up to about 250 ips. The faster the electron beam traversing speed, the more practical the process would be for commercial operations and faster speeds would reduce the number of electron beam units that would be necessary to effect the domain refinement of narrow substantially parallel bands of treated regions separated by untreated regions substantially transverse to the rolling direction.

Figure 2:
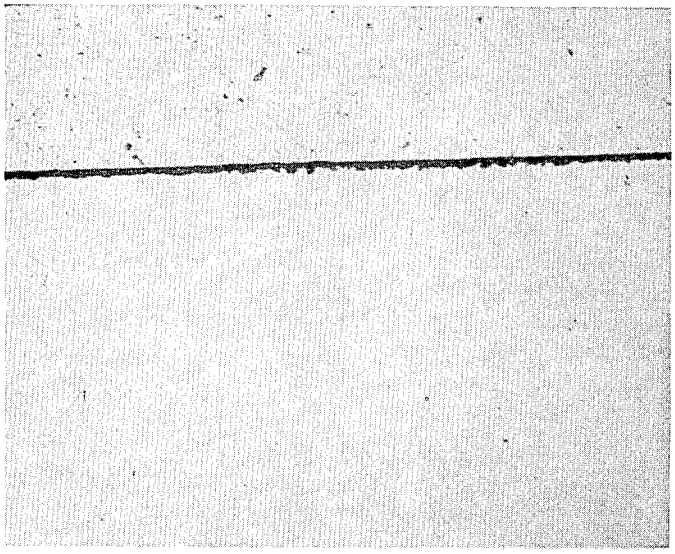
FIG. 2 is a photomicrograph in cross-section of Steel 2 in accordance with the present invention.

FIG. 2 is a photomicrograph in cross-section of Steel 2 at 400× from an optical microscope shown by nital etching (with copper spacer) illustrating a domain refined sample without any disruption of the coating and no evidence of a resolidified melt zone in the treated region. The sample of FIG. 2 was subjected to electron beam treatment of 0.5 J/in. at 150 kV, 1 ma, and 300 ips.

Figure 3:
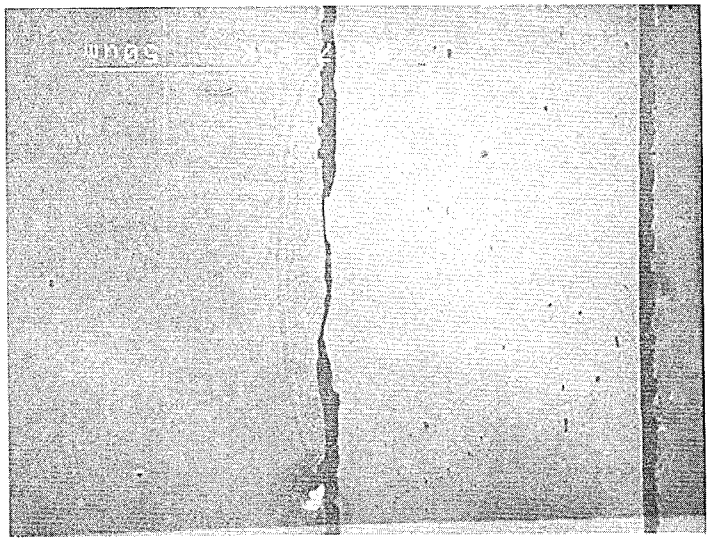
FIG. 3 is a photomicrograph in cross-section of Steel 2 illustrating coating damage and a resolidified melt zone.

FIG. 3 is an SEM photomicrograph at 600× of Steel 2 in cross-section shown by nital etching (with copper spacer) illustrating coating damage and a shallow resolidified melt zone in the treated region of about 12 microns. The sample of FIG. 3 was subjected to electron beam treatment of 2.25 J/in at 150 kV, 0.75 ma, and 50 ips and shows coating intact with some disruption.

EXAMPLE III

Figure 4:
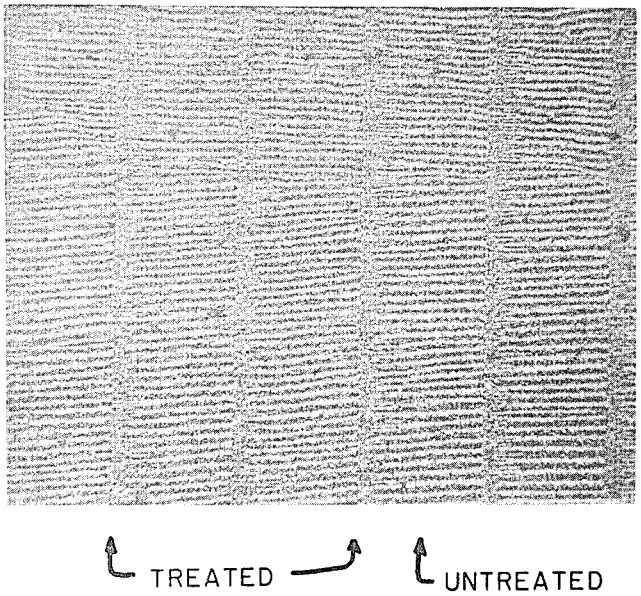
FIG. 4 is a 6× photomicrograph of the magnetic domain structure of Steel 1 of Example III, in accordance with the present invention.

By way of further examples, additional tests were performed to demonstrate the domain refining process on conventional grain-oriented silicon steels having the typical composition of Steel 1. Each sample was prepared in a manner similar to that in Example I, with required modifications to produce a conventional grain-oriented silicon steel at nominally 7-mil or 9-mil gauge and thereafter processed under the experimental conditions described in Table III with parallel bands of treated regions about 3 mm apart. All of the magnetic properties are Epstein Packs results and the domain structure is shown in the 6× photomicrograph of FIG. 4 illustrating typical domain refinement and parallel bands of treated regions.

TABLE III

| Epstein Pack | Gauge Mils | Electron Beam Conditions Current ma | Voltage kV | Speed ips | % Improvements in Core Loss 1.3 T | 1.5 T | 1.7 T | Core loss @ 60 Hz mWPP 1.3 T | 1.5 T | 1.7 T | Permeability @ 10 H | @ 200 B | Linear Energy Density Joules/inch |
|---|---|---|---|---|---|---|---|---|---|---|---|---|---|
| D7-88709-0 | | | | | | | | | | | | | |
| (Control) | 7 | — | — | — | — | — | — | 292 | 409 | 625 | 1849 | 11,360 | — |
| (Treated) | | .75 | 150 | 250 | 2.7 | 4.4 | 8.2 | 284 | 391 | 574 | 1840 | 11,900 | 0.45 |
| D7-88743 | | | | | | | | | | | | | |
| (Control) | 7 | — | — | — | — | — | — | 296 | 415 | 637 | 1846 | 11,630 | — |
| (Treated) | | .75 | 150 | 250 | 2.4 | 5.1 | 10.2 | 289 | 394 | 573 | 1839 | 12,270 | 0.45 |
| D7-86839 | | | | | | | | | | | | | |
| (Control) | 9 | — | — | — | — | — | — | 311 | 430 | 630 | 1856 | 11,980 | — |
| (Treated) | | .75 | 150 | 250 | 5.8 | 6.7 | 8.6 | 293 | 401 | 576 | 1851 | 14,390 | 0.45 |

The data of Table III shows that electron beam domain refining of conventional grain-oriented silicon steels can reduce the core loss in 7-mil material from approximately 5% at 1.5T up to about 10% at 1.7T. The core loss in 9-mil material was reduced from about 6% at 1.5T up to 9% at 1.7T. All of the examples exhibited negligible warping or curvature as a result of the domain refining process and none exhibited any visible disruption or damage to the coating.

Prior to obtaining the results shown in Table III, strips of Steel 1 at 9 mils were tested at various scanning speeds to determine the effect on domain refinement at the beam conditions of 150 kV and 0.75 ma. Comparisons of domain images for strip treated at linear energy densities ranging from 0.22 to 0.75 J/in. indicate that the threshold for effective domain refinement under those conditions may be 0.3 J/in (about 60 J/in$^2$). Domain images demonstrate that electron beam treatment under those conditions yielded domain refinement with approximately 3-millimeter spacing.

EXAMPLE IV

Further tests were performed to effect domain refining at different electron beam conditions and at greater traversing speeds which would be advantageous for higher production speeds. All of the samples were obtained from various heats of nominally 9-mil gauge silicon steel having the typical composition of Steel 2. Each sample was prepared in a manner similar to that in Example II but treated under the experimental conditions described in Table IV. All of the magnetic properties are single sheet results from 4×22 inch panels.

Preliminary tests were conducted for two traversing speeds of 1000 and 2000 ips over a range of electron beam currents ranging from 2 to 10 ma resulting in linear energy densities from 0.14 to 1.47 Joules/inch. Comparisons confirmed that approximately 0.3 Joules/inch is the threshold energy density for initiating domain refinement at 150 kilovolts beam voltage with a beam spot size of 5 mils. Coating damage appeared to be initiated between 1.2 and 1.4 J/in.

TABLE IV

| Single Sheet Sample | Electron Beam Conditions: Current ma | Voltage kV | Speed ips | Linear Energy Density (J/in) | Core loss @ 60 Hz mWPP: 1.3 T | 1.5 T | 1.7 T | Permeability @ 10 H | @ 200 B |
|---|---|---|---|---|---|---|---|---|---|
| 69ABC | | | | | | | | | |
| (Control) | — | — | — | — | 300 | 412 | 589 | 1895 | 12,420 |
| (Treated) | 4 | 150 | 2080 | 0.29 | 288 | 400 | 578 | 1891 | 13,160 |
| 64ABC | | | | | | | | | |
| (Control) | — | — | — | — | 301 | 418 | 589 | 1898 | 11,630 |
| (Treated) | 5 | 150 | 2080 | 0.36 | 290 | 400 | 566 | 1893 | 12,500 |
| 75ABC | | | | | | | | | |
| (Control) | — | — | — | — | 302 | 420 | 600 | 1882 | 12,350 |
| (Treated) | 6 | 150 | 2080 | 0.43 | 290 | 400 | 563 | 1881 | 13,160 |
| 50ABC | | | | | | | | | |
| (Control) | — | — | — | — | 304 | 432 | 615 | 1909 | 10,360 |
| (Treated) | 5 | 150 | 2080 | 0.36 | 293 | 411 | 581 | 1908 | 11,110 |
| 54ABC | | | | | | | | | |
| (Control) | — | — | — | — | 326 | 453 | 640 | 1900 | 10,100 |
| (Treated) | 5 | 150 | 2080 | 0.36 | 299 | 415 | 590 | 1900 | 11,110 |

Under the conditions described, excellent results were obtained for slightly lower linear energy density at higher currents and greater traversing speeds than in Example II. None of the samples exhibited any visible disruption or disturbance of the coating and only a slight curvature or warpage of the strip. All of the samples showed core loss reductions ranging from 3 to 8% at 1.5T. The electron beam treatment seems to be more effective when the initial core losses are higher in material already having high permeability, such as greater than 1880 at 10 Oersteds, such as material with relatively large grain sizes. The treatment does not seem to significantly improve material initially having relatively lower watt losses.

The data of Examples I through IV demonstrate that domain refined materials having reduced core loss can be produced from the present invention. Comparison of magnetic properties of all the samples, before and after electron beam treatment indicates that a trade-off exists between the core loss benefits of the domain refinement and some reductions in other magnetic properties. For example, permeability at 10H tends to decrease after electron beam treatment in magnitude proportional to the linear energy density. On the other hand, the permeability at 200 Gauss increases after electron beam treatment as a result of the reduced domain wall spacing.

EXAMPLE V

Additional tests were performed to demonstrate the domain refining process on amorphous electrical strip material having a typical composition of Steel 3. Strip was prepared by rapid solidification techniques into 4.8 in. wide continuous strip form and then annealed at about 720° F. (380° C.) for 4 hours in a magnetic field of about 10 Oersteds. The strip was used to prepare an Epstein pack of about 200 grams from 108 strip pieces 3 cm×30.5 cm. One surface of each strip was subjected to an electron beam treatment to produce parallel treated regions about 6 mm apart extending substantially transverse to the casting direction. The electron beam treatment parameters included a scanning speed of 180 ips at 150 kV and 1.1ma to provide a linear energy density of 0.92 Joules/inch.

TABLE V

| 60 Hz Induction (Tesla) | Core Loss (WPP): Before | After | % Improvement |
|---|---|---|---|
| 1.0 | .0480 | .0460 | 4.2 |
| 1.1 | .0562 | .0537 | 4.4 |
| 1.2 | .0657 | .0629 | 4.3 |
| 1.3 | .0772 | .0732 | 5.2 |
| 1.4 | .0989 | .0832 | 15.9 |
| 1.5 | .128 | .109 | 14.8 |

The electron beam treatment resulted in useful improvements in core losses at all the induction levels tested, and particularly at 1.4T and above for the amorphous magnetic material. Furthermore, none of the strips exhibited any visible damage to the surface thereof and none of the strips exhibited any warpage or curvature of the strips.

As was an object of the present invention, a method has been developed using electron beam treatment for effecting domain refinement of electrical steels, particularly exemplified by grain-oriented silicon steel to improve core loss values. A further advantage of the method of the present invention is the ability to control the electron beam conditions such that amorphous materials may be subjected to the domain refining process to further improve the already low core loss values generally associated with amorphous materials.

Although a preferred and alternative embodiments have been described, it would be apparent to one skilled in the art that changes can be made therein without departing from the scope of the invention.

What is claimed is:

1. A method for improving the core loss properties of an electrical sheet product, the method comprising:

annealing an electrical metal sheet to obtain its magnetic properties;

thereafter subjecting at least one surface of the sheet to an electron beam treatment to produce narrow substantially parallel bands of treated regions separated by untreated regions substantially transverse to the direction of strip manufacture without substantially changing the sheet shape;

the electron beam treatment including generating an electron beam with a voltage of 20 to 200 kilovolts, and providing an energy density sufficient to solely and directly effect a refinement of magnetic domain wall spacing and reduced core loss without damaging the surface, the energy density ranging from about 60 Joules per square inch or more.

2. The method of claim 1 wherein the energy density ranges from 60 to 240 Joules per square inch.

3. The method of claim 1 wherein the linear energy density ranges from about 0.3 JOules per inch up to a value less than that which would cause surface damage for an electron beam spot size of about 5 mils across.

4. The method of claim 3 wherein the linear energy density ranges from 0.3 to 1.2 Joules per inch.

5. The method of claim 1 wherein the electron beam is generated with a current of 0.5 to 100 milliamperes.

6. The method of claim 1 wherein the sheet is steel selected from a group consisting of conventional cube-on-edge grain-oriented silicon steel, high permeability cube-on-edge grain-oriented silicon steel and amorphous magnetic metal.

7. The method of claim 6 wherein the method includes annealing the electrical steel to obtain magnetic properties and thereafter subjecting the steel to the electron beam treatment.

8. The method of claim 1 wherein the sheet final gauge ranges up to about 14 mils.

9. The method of claim 1 including the step of providing at least a partial vacuum in the vicinity of the sheet being subjected to the electron beam treatment.

10. The method of claim 9 wherein the focussed electron beam spot size produced is about 4 to 16 mils across.

11. The method of claim 1 including the step of providing deflection of the electron beam substantially transverse to the rolling direction of the sheet at a speed of up to 10,000 inches per second.

12. A method for improving the core loss properties of a coated electrical sheet product, the method comprising:

annealing an electrical sheet to obtain magnetic properties;

thereafter subjecting at least one surface of the annealed sheet to an electron beam treatment in the vicinity of at least a partial vacuum to produce narrow bands of treated regions separated by untreated regions substantially transverse to the direction of sheet manufacture without substantially changing the sheet shape;

the electron beam treatment includes providing sufficient energy density ranging from 60 Joules per square inch or more, and providing relative movement between the electron beam and the sheet of up to 10,000 inches per second substantially transverse to the direction of rolling of the sheet, the electron beam treatment solely and directly effects refinement of magnetic domain wall spacing and reduced core loss without damaging the coating.

13. A method for improving the core loss properties of grain-oriented silicon steel sheet product, the method comprising:

final texture annealing grain-oriented silicon steel sheet;

thereafter subjecting at least one surface of the grain-oriented sheet to an electron beam treatment to produce narrow substantially parallel bands of treated regions separated by untreated regions substantially transverse to the direction of strip manufacture without substantially changing the sheet shape;

the electron beam treatment including generating an electron beam with a voltage of 20 to 200 kilovolts, and providing an energy density sufficient to effect a refinement of magnetic domain wall spacing and reduced core loss without damaging the surface, the energy density ranging from about 60 Joules per square inch or more.

14. A method for improving the core loss properties of an electrical sheet product, the method comprising:

subjecting at least one surface of the electrical steel sheet having a coating thereon to an electron beam treatment to produce narrow substantially parallel bands of treated regions separated by untreated regions substantially transverse to the direction of strip manufacture without substantially changing the sheet shapê;

the coating being at least one selected from the group consisting of surface oxides, forsterite base coatings, mill glass, applied coatings, and insulation coatings;

the electron beam treatment including generating an electron beam with a voltage of 20 to 200 kilovolts, and providing an energy density sufficient to effect a refinement of magnetic domain wall spacing and reduced core loss without damaging the surface, the energy density ranging from about 60 Joules per square inch or more.

* * * * *